US010105971B1

(12) United States Patent
Estella et al.

(10) Patent No.: US 10,105,971 B1
(45) Date of Patent: Oct. 23, 2018

(54) PLATEN RIB PROTECTOR

(71) Applicant: HEWLETT-PACKARD DEVELOPMENT COMPANY, L.P., Houston, TX (US)

(72) Inventors: Albert Estella, Sant Cugat del Valles (ES); Xavier Domingo Reguant, Sant Cugat del Valles (ES); Bhsihma Hernandez Martinez, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/696,490

(22) Filed: Sep. 6, 2017

(51) Int. Cl.
*B41J 11/13* (2006.01)
*B41J 2/01* (2006.01)

(52) U.S. Cl.
CPC *B41J 11/13* (2013.01); *B41J 2/01* (2013.01)

(58) Field of Classification Search
None
See application file for complete search history.

(56) References Cited

U.S. PATENT DOCUMENTS 4,229,200 A * 10/1980 Seymour ..... C03B 23/0256 65/104
5,065,620 A * 11/1991 Bares ..... G01N 15/08 118/713
7,177,585 B2 2/2007 Matsuzaka
7,509,068 B2 3/2009 Hama
8,170,456 B2 5/2012 Young
2004/0179081 A1* 9/2004 Nimi ..... B41J 2/01 347/104
2005/0072071 A1* 4/2005 Bonner, Jr. ..... B65D 90/023 52/169.14
2011/0050762 A1* 3/2011 Sakakibara ..... B41J 11/008 347/1
2014/0002542 A1* 1/2014 Chino ..... B41J 2/16535 347/33
2014/0283701 A1 9/2014 Lewis et al.
2016/0347092 A1 12/2016 Kurata et al.

OTHER PUBLICATIONS

Magrans, New Output Platen Protector Available for HP Latex 330, HP Latex 360 and HP Latex 370 Printers, Dec. 14, 2015.

* cited by examiner

*Primary Examiner* — Erica Lin

(74) *Attorney, Agent, or Firm* — HP Inc. Patent Department

(57) ABSTRACT

A platen protector for a printer device has a protector blanket to cover a printer platen of the printer device to prevent from causing scratches on print media by the printer platen. The platen protector has a fixing system to fixate the platen protector relative to the printer platen. The protector blanket is porous to pass through vacuum applied by the printer platen to attract print media.

15 Claims, 5 Drawing Sheets

PLATEN RIB PROTECTOR

BACKGROUND

Some printer devices have a print zone equipped with a printer platen to support print media. The printer platen can cause scratches on sensible print media when the print media advance through the print zone.

BRIEF DESCRIPTION OF THE DRAWINGS

Examples will be described, by way of example only, with reference to the accompanying drawings in which corresponding reference numerals indicate corresponding parts and in which.

Figure 1:
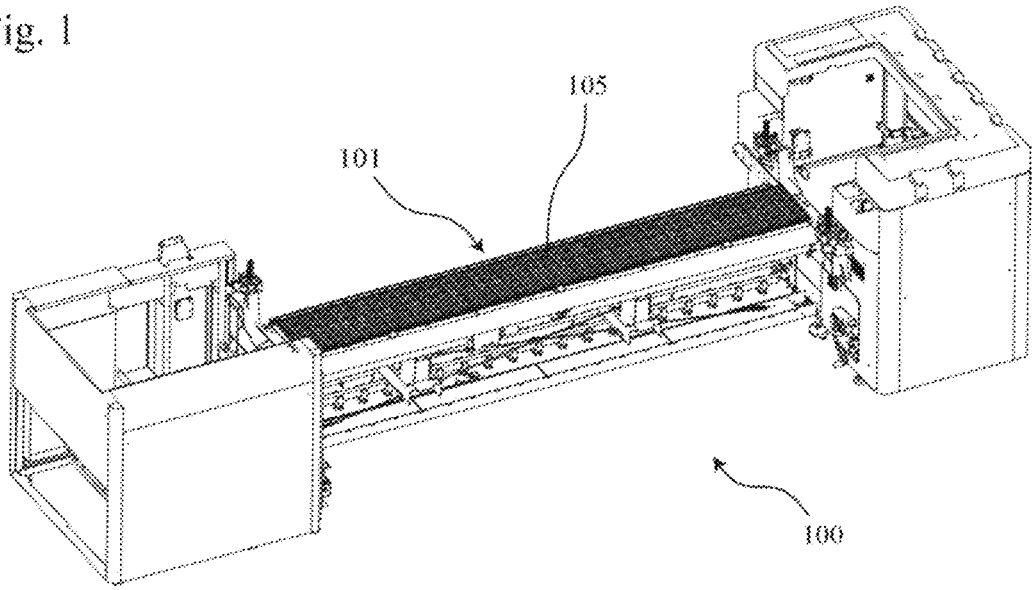
FIG. 1 illustrates a schematic overview of an example printer device.

Moreover the drawings provide examples and/or implementations consistent with the description; however, the description is not limited to the examples and/or implementations provided in the drawings.

DETAILED DESCRIPTION

The description refers to a platen protector for a printer device. The description also refers to a printer device comprising the platen protector and a method of installing the platen protector at the printer device.

An example platen protector for a printer device has a protector blanket to cover a printer platen of the printer device to prevent from causing scratches on print media by the printer platen. The platen protector further has a fixing system to fixate the platen protector relative to the printer platen. The protector blanket of the example platen protector is porous to pass through vacuum applied by the printer platen to attract print media.

An example printer device has a printer platen, which has holes to apply vacuum to attract print media. The example printer device further has a platen protector, which has a protector blanket to cover the printer platen of the printer device to prevent from causing scratches on print media by the printer platen. The platen protector further has a fixing system to fixate the platen protector relative to the printer platen. The example platen protector is porous to pass through vacuum applied by the printer platen to attract print media.

In an example method of installing a platen protector at a printer device, the printer device has a printer platen, wherein the printer platen has holes to apply vacuum to attract print media. The platen protector has a protector blanket to cover the printer platen of the printer device to prevent from causing scratches on print media by the printer platen and a fixing system to fixate the platen protector relative to the printer platen. The protector blanket is porous to pass through vacuum applied by the printer platen to attract print media. The example method includes situating the protector blanket at the printer platen, and fixating the protector blanket relative to the printer platen by the fixing system.

In some examples, the printer platen is arranged in a print zone of the printer device. For example, the printer platen is arranged along the (possible) printing positions of a print head of the printer device. In some examples, the printer device is an inkjet printer, e.g. with one or more scanning type inkjet print heads. In some examples, the printer platen is arranged under the print head and/or the print head's scanning path, i.e. in a vertical direction opposite to the print head from a perspective of the print media currently being printed on. In some examples, the printer device can perform dual side printing by first printing on a first side of a print media and then printing on the opposite second side of the print media.

In the following, the side of the print media facing the print head while printing is referred to as "upper side" and the opposite side of the print media is referred to as "lower side". This is not to be understood to limit the printer in any regard. The printer can print on vertically aligned print media and/or on horizontally aligned print media and/or on print media under an angle, for example.

In some examples, the platen protector is mountable and dismountable to the printer device by a single operator of the printer device. For example, this allows the operator of the printer device for easily install the platen protector to the printer device in order to print sensible print media as well as to easily uninstall the platen protector from the printer device, e.g. for printing less sensible print media. For example, the platen protector does not restrict the versatility or capability of the printer device of handling different types of print media, but rather the platen protector enhances the capability of the printer device with reward to, e.g. scratch-sensible print media. The platen protector can represents an accessory that the operator installs before specific jobs with sensitive media, and after it, the platen protector can be removed and return the printer device to its initial media control, working as usual (i.e. without the platen protector), for example.

For example, the platen protector is arranged on top of the printer platen. The protector blanket forms an additional layer between the print media and the printer platen. In a situation when the platen protector is mounted to the printer device, the platen protector allows for covering the printer platen by the protector blanket of the platen protector. The protector blanket protects against scratches on sensible print media otherwise caused by the printer platen. This enhances the capability of the printer device to print on print media with sensible coatings, for example.

The printer platen has one or more holes to apply vacuum to attract print media towards the printer platen. The vacuum helps to hold down print media, supports appropriate alignment of the print media and/or prevents the print media from curling and/or wrinkling, for example. The protector blanket of the platen protector is porous to pass the vacuum through the protector blanket towards the print media. This allows for maintaining the vacuum's effect on the print media even with the platen protector being installed at the printer device. In some examples, the protector blanket includes a textile or the protector blanket is a textile blanket. In these examples, the mesh of the textile builds a porous layer for, on the one hand, passing through the vacuum, and, on the other hand, protecting the print media from scratches caused by contacting the printer platen.

In some examples, the protector blanket is anti-static. This prevents the protector blanket and/or the print media from becoming electrically charged, for example. This can also prevent from spark formation, for example.

In some examples, the printer device has a heat source for applying heat in the print zone. This can reduce drying time of printed ink, for example. In some examples, the protector blanket is heat-resistant and/or flame retardant. This allows for the printer device applying heat by the heat source in the print zone and not damaging the platen protector, for example.

In some examples, the protector blanket is of black color. This provides for a high contrast with the print media for detecting the print media by optical sensors, for example. In some examples, the blanket is black and the printer platen is black. This allows for the printer device detecting the media width, e.g. by an optical sensor, both with and without the platen protector being installed at the printer.

In some examples, the protector blanket has one or more marks for indicating an upper and/or lower side and/or an inner and/or outer side of the protector blanket, which allows for correctly installing the platen protector to the printer device.

In some examples, an optical media advance sensor (hereinafter OMAS) is arranged at the printer platen to monitor advance of print media. For example, the OMAS looks at the lower side of the print media. In some examples, the printer platen is equipped with one or more optical media advance sensors. For example, the printer device can determine, by the OMAS, media advance, e.g. the distance moved during the media advance. In some examples, errors with regard to the media advance can be corrected, by the printer device, in real time based on information obtained by the OMAS. In some examples, the printer device recognizes, by the OMAS, registration marks (already printed on the lower side of the print media), e.g. to ensure correct registration from side to side on dual side prints. In some examples, the printer platen includes multiple platens, including one or more platens carrying an OMAS. In some examples, the printer platen includes one or more OMAS-free platens, i.e. platens not carrying an OMAS.

In some examples, the protector blanket has one or more windows to monitor advance of print media through the window by one or more OMAS. A window of the protector blanket allows for an OMAS to maintain monitoring the advance of print media (even with the platen protector being installed at the printer device). For example, the OMAS can look through the window of the protector blanket at the lower side of the print media to monitor the print media advance.

In some examples, the window for the OMAS has a structural shape that corresponds to a contour of the OMAS. This enables the operator to easily align the protector blanket relative to the printer platen when mounting the platen protector. For example, the one or more windows of the protector blanket have a shape that allows for catching the one or more OMAS to easily align the protector blanket relative to the printer platen. In some examples, the method of installing the platen protector at the printer device further includes aligning the protector blanket by taking one or more optical media advance sensor and one or more windows of the protector blanket as reference.

In some examples, the protector blanket is windowless. For example, the protector blanket has a closed surface apart from being porous. For example, the protector blanket represents a homogeneous surface for supporting the print media—free of protrusions potentially casing scratches on the print media. In these examples, the OMAS is blinded by the protector blanket when the platen protector is mounted on the printer device.

In order to, e.g. monitor media advance in situations with the OMAS being blinded by the platen protector, in some examples, the printer device has one or more, e.g. two, optical sensors arranged to look at the upper side of print media, i.e. these sensors are mounted on the same side relative to the print media as the print head. Therefore, these sensors are referred to as "upper side" optical sensor hereinafter. In some examples, one or two or more upper side optical sensors are mounted at a print head or at a carriage for carrying one or more print heads.

In some examples, an upper side optical sensors include a colorimeter measurement device, e.g. to facilitate the printer device to determine printed color accuracy. In some examples, the upper side optical sensor is used to monitor advance of print media. For example, the upper side optical sensor can take the task of the OMAS, e.g. in case of the OMAS being blinded by the protector blanket while the platen protector is mounted at the printer device.

In some examples, the printer device has at least two upper side optical sensors, i.e. at least a first upper side optical sensor and a second upper side sensor. The first upper side sensor and the second upper side optical sensor are of identical type and design, for example. For example, the at least two upper side optical sensors are located at the (e.g. same) print head or at the (e.g. same) carriage for carrying one or more print heads.

In some examples, the first upper side optical sensor is located a distance apart from the second upper side optical sensor with regard to a direction of print media advance and/or with regard to a direction transverse thereto. For example, the two upper side optical sensors in a distance allow for determining print media positioning by detecting fiducial marks having a skewed line pattern.

In some examples, the first upper side optical sensor is located after a print head and/or an ink applying element of a print head in the direction of print media advance and the second upper side optical sensor is located before the print head and/or ink applying element in the direction of print media advance. This allows the first upper side optical sensor to determine colors of actually printed ink and the second upper side optical sensor to determine, e.g. arrival and/or position of print media and/or registration marks just before printing, e.g. for increasing alignment accuracy when printing.

In some examples, the printer device has a light source located at or below a level of the printer platen (from a perspective of the print head) to illuminate the lower side of the print media. This allows for light shining through the print media in case of translucent print media, for example. In some examples, an upper side optical sensor, which is located opposite to the light source with regard to the print media, e.g. the second upper side optical sensor, determines fiducial marks printed on the lower side of the print media in case of translucent print media. This allows for increasing consistency in dual side printing, e.g. in so-called "Night and Day" printing, which is printing two images on opposite sides of translucent media, wherein one of the two images becomes visible in incident-light illumination and a superimposition of both images becomes visible in backlight illumination of the printed translucent media.

As described before, the platen protector has a fixing system to flexibly mount and dismount the platen protector to the printer device, e.g. by the operator of the printer device. This allows the operator to mount the platen protector to the printer device on demand. For example, the platen protector can be mounted to the printer device when printing sensible print media and the platen protector can be dismounted from the printer device when printing less sensible print media.

In some examples, the fixing system has one or more magnetic fixation devices to fasten the platen protector to the printer device. In some of these examples, multiple magnetic fixation devices are arranged at one of the length sides of the platen protector. This allows for easy installation of the platen protector, for example. In some other examples, multiple magnetic fixation devices are arranged at either length sides of the platen protector. This allows for a symmetric arrangement of the magnetic fixation devices, e.g. for wrinkle-free mounting the platen protector. In some examples, magnetic fixation devices are pairwise located opposite to each other on opposite length sides of the protector blanket. This can prevent the protector blanket from curling in that tensioning forces applied by the pairs of magnetic fixation devices run perpendicular to the length side of the protector blanket. For example, the platen protector can be fixed by the magnetic fixation device(s) on a rear part of the print zone (i.e. where print media enter the print zone), e.g. between the printer platen and a drive roller.

In some examples, the fixing system has one or more, e.g. three, tensioner elements to fasten the platen protector to the printer device. In some of these examples, multiple tensioner elements are arranged at one of the length sides of the platen protector. This allows for easy installation of the platen protector, for example. In some other examples, multiple tensioner elements are arranged at either length sides of the platen protector. This allows for a symmetric arrangement of the tensioner elements, for example. In some examples, tensioner elements are pairwise located opposite to each other on opposite length sides of the protector blanket. This can prevent the protector blanket from curling in that tensioning forces applied by the pairs of tensioner elements run perpendicular to the length side of the protector blanket. For example, the platen protector can be fixed by the tensioner element(s) on a front part of the print zone (i.e. where print media leave the print zone), e.g. between the printer platen and a diverter wheels.

In some examples, a tensioner element includes a plastic extrusion member, e.g. made of poly-phenylen-oxide, with a shape that provides the element with elasticity to be introduced on its positon and to be tensioned. For example, the tensioner element includes a nose shape to be snapped to the printer platen. For example, the tensioner element has an elongated shape that avoids rotation of the tensioner element.

In some examples, the fixing system has a flange to align the platen protector relative to the printer platen. In some example, the flange is foldable, e.g. to clamp the platen protector to the printer device. In some examples, the flange includes and/or represents a tensioner element as described before.

In some examples, the fixing system has one or more catches on a length side of the protector blanket opposite to the magnetic fixation device(s) or the tensioner element(s) respectively. In some examples, pairs of catches and magnetic fixation devices or pairs of catches and tensioner elements provide for building up tensioning forces for wrinkle-free mounting the protector blanket at the printer platen.

In some examples, the fixing system has magnetic fixation device(s) on one length side of the protector blanket and tensioner element(s) on the (opposite) other length side of the protector blanket. In some examples, pairs of magnetic fixation device and tensioner elements provide for building up tensioning forces for wrinkle-free mounting the protector blanket at the printer platen.

In some examples, the fixing system comprises a rod, e.g. made of steel. For example, the rod is located at a length side of the protector blanket to reduce formation of wrinkles of the protector blanket. In some examples, the rod extends (substantially) along the length of the protector blanket. In some examples, a rod is mounted, e.g. glued, on a single length side or, in some other examples, on either length side of the protector blanket. In some examples, at least one magnetic fixation device is mounted or the rod. In some examples, multiple, e.g. two, three or more magnetic fixation devices are mounted along the rod, e.g. equidistantly distributed along the rod and/or the protector blanket. For example, a magnetic fixation device includes a plastic extrusion member, e.g. made of poly-phenylen-oxide and 20% glass fiber. The plastic extrusion member includes a rail to introduce the rod, in some examples.

The method of installing the platen protector includes, in some examples, fixing the protector blanket on the printer platen, e.g. on a rear part of the printer platen, using a magnetic fixation device. In some examples, the method further includes (e.g. after fixing the protector blanket with the magnetic fixation) stretching the blanket over a printer platen surface. In some examples, the method further includes (e.g. after stretching the blanket) fixing the protector blanket using a tensioner element.

In some examples, the platen protector has one or more edge holders to hold down the protector blanket towards the printer platen. In some examples, the edge holder spans the width of the printer platen, i.e. in the direction of the print media advance. For example, the edge holder has a fastening element on either side to fasten the edge holder (directly) to the printer platen. In some examples, the edge holder is elastic to apply tensioning forces to hold down the protector blanket.

For example, the edge holder(s) cover(s) a leading edge and/or a trailing edge of the protector blanket. In some examples, the leading edge and/or a trailing edge of the protector blanket represent the short length sides of the protector blanket. For example, the leading edge is the edge oriented towards a parking position of the print head. In some examples, the platen protector has two edge holders, which are located on opposite sides, e.g. the leading edge and the trailing edge, of the protector blanket in a direction along a length side of the platen protector. Edge holders can prevent from the print head crashing the platen protector, for example.

In some examples, the method of installing the platen protector further includes (e.g. after fixing the protector blanket using a tensioner element) installing an edge holder.

In some examples, the protector blanket covers at least a portion of the printer platen. In some examples, the protector blanket covers the full length of the printer platen and/or a maximum printing width of the printer device. In some other examples, a length of the protector blanket is (substantially) less than the maximum printing width of the printer device. For example, the length of the protector blanket corresponds to a width of the print media to be printed and/or a width of the print out, which is less than the print media width.

In some examples, the platen protector has two separate protector blankets. For example, a length of the protector blanket corresponds to half the length of the printer platen. For example, the length of the protector blanket is 60 inch for a 120 inch length of the platen. One of the two protector blankets can be installed from the left side of the printer device and the other one can be installed from the right side. In total, the two protector blankets cover the entire length of the printer platen, in some examples. This simplifies for the operator of the printer system the mounting and dismounting of the platen protector.

In some examples, an operator is enabled to install either one of the two separate protector blankets or both protector blankets, e.g. for printing small width or large width print media. The method of installing the platen protector includes, in some examples, determining the width of the print out and/or determining the width of the print media and/or determining the width of the printer zone. Based on this, either one or two protector blankets are installed at the printer. For example, a single 60 inch protector blanket (for covering 60 inch of the printer platen) is installed to the printer device for printing up to 60 inches print out width. For example, two 60 inch protector blankets (for covering 120 inch of the printer platen) are installed to the printer device for printing up to 120 inch print out width.

In some examples, the protector blanket has a thickness of about 0.2 mm, 0.3 mm, 0.5 mm or 0.8 mm, for example. On the one hand, this allows for installing the platen protector at a printer device without disturbing the printing functionality of the printer device. On the other hand, the thickness of the protector blanket allows for sufficiently protecting the print media against scratches caused by the printer platen. For example, the protector blanket is made of the commercially available textile CICHAMOIS TYBL@043ECO by CHIYODA INTEGER CO., LTD, Shenzhen City, China.

In some examples, the printer platen has ribs protruding from a surface of the printer platen to support the print media. The ribs can control de-wrinkle of the media created during printing, as an effect of temperature and ink humidity, for example. Controlling wrinkle during a printing job allows for increasing image print quality. Applying vacuum by the printer platen attracts the protector blanket to the printer platen and the protector blanket thereby snuggles the ribs and also covers them. For example in order to flatten peaks on the surface of the protector blanket caused by an embossing effect of the ribs, in some examples, the platen protector further includes a reinforcement sheet, e.g. to cover the ribs of the printer platen. The reinforcement sheet can be installed as an intermediate layer between the printer platen and the protector blanket. When the reinforcement sheet is installed between the printer platen and the protector blanket, the protector blanket covers the reinforcement sheet.

The reinforcement sheet comprises an opening to pass through vacuum applied by the printer platen to attract print media. The reinforcement sheet is stiffer than the protector blanket. For example, this allows for the reinforcement sheet to reduce the embossing effect of the ribs and flattens peaks appearing on the surface of the protector blanket when applying vacuum. The reinforcement sheet allows for the platen protector to protect even more sensible print media against scratches than the platen protector being used without the reinforcement sheet.

In some examples, the platen protector can be installed with and without the reinforcement sheet, i.e. the reinforcement sheet is mountable and dismountable separately from protector blanket to the printer device. For example, this allows the operator of the printer device for easily install the protector blanket in combination with the reinforcement sheet to the printer device in order to print even more sensible print media as well as to easily uninstall the reinforcement sheet and installing the protector blanket without the reinforcement sheet, e.g. for printing less sensible, but nevertheless sensible print media. Neither the protector blanket nor the reinforcement sheet restricts the versatility or capability of the printer device of handling different types of print media. Rather, options to either use or not use the reinforcement sheet in addition to the protector blanket enhances the capability of the printer device with regard to highly scratch-sensible print media.

In order to (e.g. completely) cover the ribs, in some examples, the openings of the reinforcement sheet are placed at positions other than positions corresponding to the ribs, e.g. at positions in between of directly neighboring ribs. In some examples, the reinforcement sheet has one or more windows to monitor advance of print media through the window by the one or more OMAS of the printer device. In some examples, a window for an OMAS is a hole of the reinforcement sheet. In these examples, the reinforcement sheet has at least two kinds of holes, namely the one or more openings for the vacuum and one or more windows for OMAS. In some other examples, the reinforcement sheet's window for the OMAS includes a transparent portion of the reinforcement sheet, e.g. a transparent polycarbonate section. In some examples, the window has a structural shape that corresponds to a contour of the OMAS. This enables the operator to easily align the reinforcement sheet relative to the printer platen when mounting the platen protector. For example, the one or more windows of the reinforcement sheet have a relief and/or shape that allows for catching the one or more OMAS to easily align the reinforcement sheet relative to the printer platen.

In some examples, the method of installing the platen protector at the printer device further includes (e.g. before installing the protector blanket) aligning the reinforcement sheet by taking one or more optical media advance sensor and one or more windows as reference.

In some examples, the reinforcement sheet's opening for the vacuum has a slit, e.g. the opening has a slit shape. A vacuum throughput can be increased in that in some examples the slit extends along a direction of the ribs (i.e. in a direction along a short side of the reinforcement sheet), whereas a slit width is smaller than the distance between two neighboring ribs. For example, the width of the opening corresponds to a clearance between neighboring ribs of the printer platen. This allows for increasing the vacuum throughput while maintaining complete coverage of the ribs, for example. In some examples, the reinforcement sheet has two, three or more than three openings arranged in a series in a direction along the ribs. In some examples, the series of two, three or more openings substantially extends over the width of the reinforcement sheet with narrow bars of reinforcement sheet material on each side of the series at the reinforcement sheet length side and narrow bars of reinforcement sheet separating neighboring openings of the series. In general, a series of openings of the reinforcement sheet means that each pair of openings of the series is separated by a bar of reinforcement sheet material.

In some examples, the reinforcement sheet has multiple openings (for the vacuum) arranged in a series in a direction transverse to the ribs. For example, the reinforcement sheet has two or three or more than three parallel series of openings in the direction transverse to the ribs, i.e. in a direction along the length side of the reinforcement sheet. For example, the positions of the bars (separating the series of openings in the direction transverse to the ribs) correspond to the positions of the ribs. When the platen protector and/or the reinforcement sheet is mounted to the printer device, these bars cover the ribs while the series of openings maintain the vacuum's effect on the print media in between the ribs.

In some examples, the reinforcement sheet has matrix like arranged openings with, for examples, two, three or more parallel series of openings extending transverse to the ribs, i.e. in a direction along the length side of the reinforcement sheet. For example, the openings of the reinforcement sheet form a mesh of openings extending over the reinforcement sheet to uniformly apply the vacuum to the print media in the area of the reinforcement sheet.

In some examples, the reinforcement sheet can be fixed to the printer platen separately from fixing the protector blanket. In some examples, the fixing system has one or more tensioner elements of the reinforcement sheet to fasten the reinforcement sheet to the printer device. In some of these examples, multiple tensioner elements are arranged at one of the length sides of the reinforcement sheet, whereas the fixing system has one or more catches on the opposite length side of the reinforcement sheet. This allows for easy installation of the reinforcement sheet, for example. In some other examples, multiple tensioner elements are arranged at either length sides of the reinforcement sheet. This allows for a symmetric arrangement of the tensioner elements to provide more orientational degrees of freedom for mounting the reinforcement sheet relative to the printer platen, for example. In some examples, tensioner elements are pairwise located opposite to each other on opposite length sides of the reinforcement sheet. This can prevent the reinforcement sheet from curling in that tensioning forces applied by the pairs of tensioner elements run in parallel to the ribs, i.e. perpendicular to the length side of the reinforcement sheet.

In some examples, the platen protector has two separate reinforcement sheets. For example, a length of the reinforcement sheet corresponds to half the length of the printer platen. For example, the length of the reinforcement sheet is 60 inch for a 120 inch length of the platen. One of the two reinforcement sheets can be installed from the left side of the printer device and the other one can be installed from the right side.

In some examples, the reinforcement sheet has a thickness of about 0.3 mm, 0.5 mm or 0.8 mm, for example. This allows for installing the platen protector at a printer device without disturbing the printing functionality of the printer device. In some examples, the reinforcement sheet is made of plastic, e.g. polycarbonate.

Now referring to FIG. 1 that shows a schematic overview of an example printer device 100. For illustration purpose, some portions of the printer device 100 are not drawn, so a printer platen 101, which extends along a print zone of the printer device 100, and a platen protector 105 mounted on top of the printer platen 101 becomes visible in FIG. 1. The platen protector 105 can be installed at the printer device 100 as described in more detail below. For example, the printer device 100 is for printing on endless print media. In some other examples, the printer device 100 is for printing on single blanket print media. In some examples, the printer device 100 is a scanning type ink jet printer, wherein a print head scans back and forth (e.g. from left to right and vice-versa in FIG. 1) it and applies ink to the print media. When printing, print media advance in a direction transverse to the print zone (e.g. from the top to the down in FIG. 1).

Figure 2:
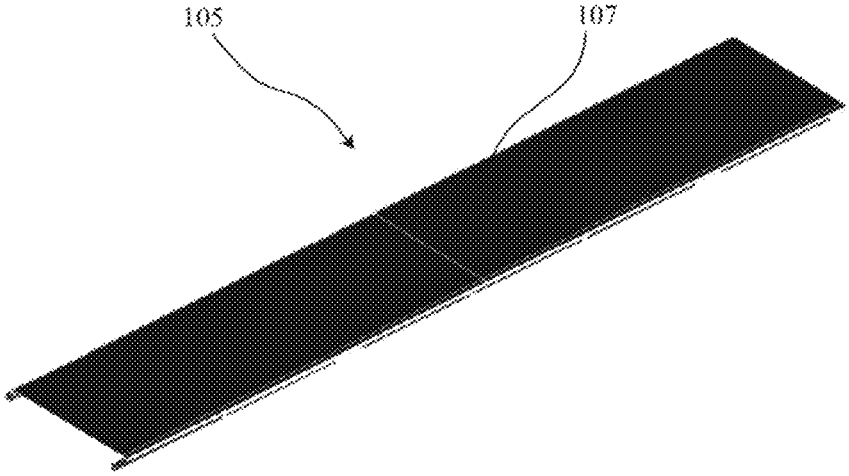
FIG. 2 illustrates a protector blanket of an example platen protector.

FIG. 2 shows the platen protector 105, which has a protector blanket 107 to cover the printer platen 101 of the printer device 100 to prevent from causing scratches on print media by the printer platen 101. For example, the protector blanket 107 is made of a black textile, which is porous due to the mesh of the textile to pass through vacuum applied by the printer platen 101 to the print media. For example, the protector blanket 107 is anti-static, e.g. to avoid electrically charging print media. For example, the protector blanket 107 is flame retardant. This prevents from damaging the protector blanket 107 by heat applied in the print zone of the printer device 100. In some examples, the protector blanket 107 has a thickness of (about) 0.3 mm.

Figure 3:
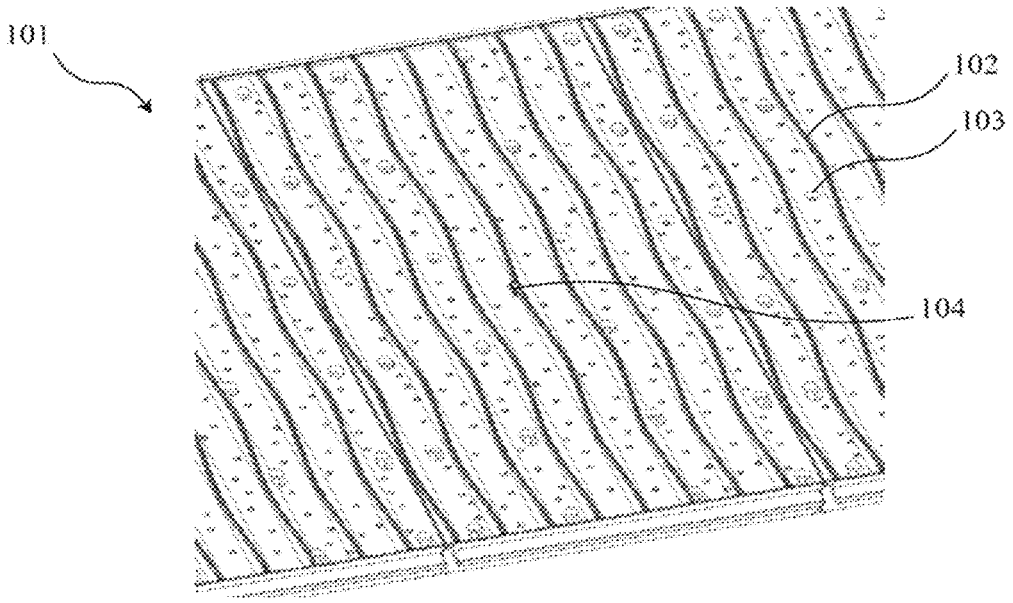
FIG. 3 is a perspective detail enlargement of FIG. 1 illustrating a printer platen of the example printer device.

In some example printer devices 100, the printer platen 101 has ribs 103. In some other example printer devices 100, the printer platen 101 is rib-less. FIG. 3 shows a perspective detail enlargement of the printer platen 101 of an example printer device 100 having ribs 103. For illustration purpose, the platen protector 105 is not shown in FIG. 2 in order to show the ribs 103 protruding from the printer platen surface to support print media. The ribs 103 prevent the print media from directly lying on the printer platen surface in situations of the platen protector 105 being not installed at the printer device 100, e.g. being temporally removed by the operator of the printer device 100. For example, the ribs 103 have a serpentine shape as illustrated in FIG. 2. In some other example printer devices, the ribs have a straight line shape.

In both cases of the printer platen 101 having ribs 103 or being rib-less, in the example printer device 100, the printer platen 101 has holes 102 to apply a vacuum to attract print media towards the printer platen 101 in the print zone. For example, the printer device 100 further has an optical media advance sensor (OMAS) 104 to optically monitor advance of print media. For example, the OMAS protrudes from the printer platen surface, e.g. by the same height as the height of the ribs 103. In some example platen protectors 105, the protector blanket 107 has one or more windows to allow the OMAS to look through the window and monitor advance of print media. In some other example platen protectors 105, the protector blanket 107 is window-less.

Figure 4:
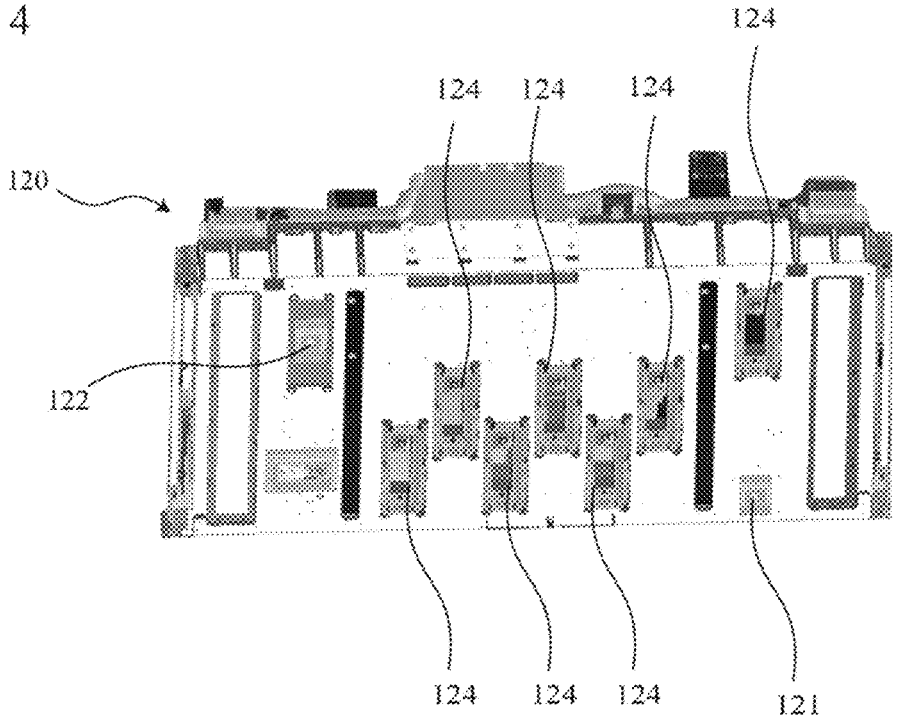
FIG. 4 illustrates a carriage of an example printer device carrying print heads.

As illustrated in FIG. 4, for example, the printer device 100 has a first optical sensor 121 and a second optical sensor 122 being mounted on a carriage 120 carrying one or more print heads 123. These sensors 121 and 122 are also referred to as "upper side" optical sensors above. For example, the first optical sensor 121 is used by the printer device 100 to determine the color printed by the print head. For example, the second optical sensor 121 is used by the printer device 100 to monitor print media advance in case of the OMAS 104 being covered by the protector blanket 107. For example, the printer device 100 has a light source to transmit light through (translucent) print media. For example, the light source is integrated in the printer platen 101 or arranged next to the printer platen 101. When printing translucent print media, light emitted by the light source passes through the print media and is sensed by the second optical sensor 121. This allows for the second optical sensor 121 to detect fiducial marks printed on a lower side of the (translucent) print media, for example. This also allows for the second optical sensor 121 to monitor advance of print media.

Figure 5:
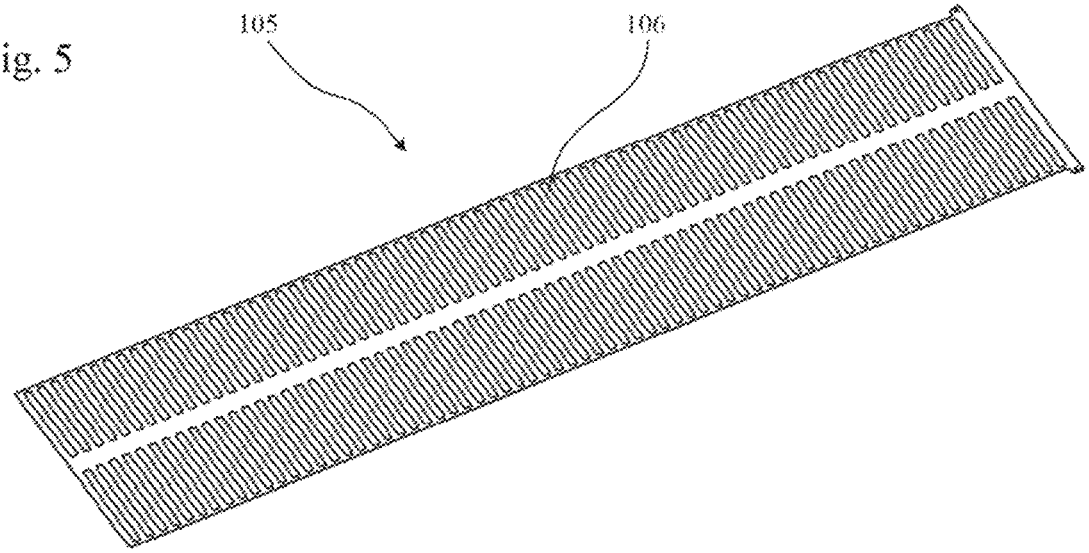
FIG. 5 illustrates a reinforcement sheet of an example platen protector.

As described before, in some example printer devices 100, the printer platen 101 has ribs 103. The example platen protector 105 has a protector blanket 107 to cover the printer platen 101 and also to cover the ribs 103 to prevent from causing scratches on sensible print media by the printer platen 101 and/or the ribs 103. However, in case of even more sensible print media, the ribs 103 embossing the protector blanket 107 to a certain degree may cause scratches on the print media despite of the protector blanket 107. In order to increase the protective effect of the platen protector 105, some example platen protectors 105 further include a reinforcement sheet 106 shown in FIG. 5. The reinforcement sheet 106 is arranged between the printer platen 101 and the protector blanket 107. The reinforcement sheet 107 is stiffer than the protector blanket 107. This allows to reduce embossing of the protector blanket 107 by the ribs 103 and to flatten the surface of the protector blanket 107 in case of the printer platen 101 having ribs 103. In some examples, the platen protector 105 can be installed in both configurations, either with the reinforcement sheet 106 or, alternatively, without the reinforcement sheet 106.

The reinforcement sheet 106 is made of polycarbonate and has a thickness of (about) 0.5 mm, for example. Therefore, in examples of the platen protector 105 that are equipped with the (optionally installable) reinforcement sheet 106, the overall thickness of the platen protector 105 can vary depending on whether the reinforcement sheet 106 is installed or not.

Figure 6:
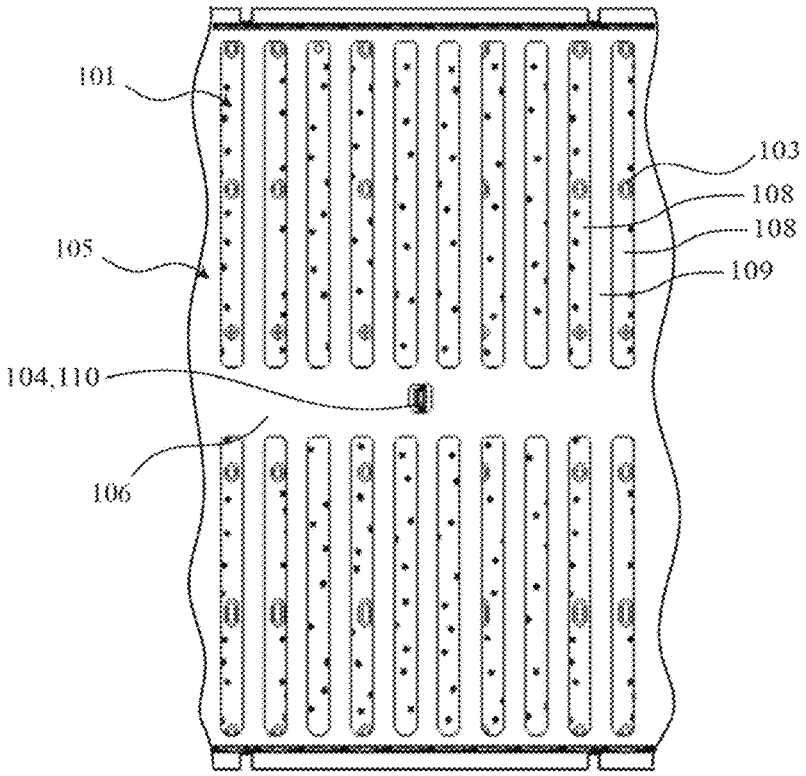
FIG. 6 illustrates a detail enlargement of the reinforcement sheet mounted on the printer platen.

FIG. 6 shows a detail enlargement of the reinforcement sheet 106 mounted on top of the printer platen 101. In FIG. 4, the protector blanket 107 is not shown, so that the reinforcement sheet 106 and the printer platen 101 become visible. The reinforcement sheet 106 (and also the not shown protector blanket 107) extends over substantially the width of the printer platen 101 (i.e. in the vertical direction in FIG. 4). The reinforcement sheet 106 has two parallel series of openings 108 to pass through vacuum applied by the holes 102 to attract print media. The parallel series of openings 108 run in a direction of a length side of the reinforcement sheet 106 (i.e. in a horizontal direction in FIG. 6), which corresponds to a length side of the printer platen 106. The openings 108 have a (rectangular) slit shape. Each pair of neighboring openings 108 is separated by a bar 109 of reinforcement sheet material. These bars 109 cover the ribs 103 when the platen protector 105 is installed at the printer device 100. The ribs 103 are not visible in FIG. 6, as they are covered by the reinforcement sheet 106 mounted on top of the printer platen 101. The width of the bars correspond to a maximum extend of the serpentine shaped ribs 103 in a direction perpendicular to the ribs 103, for example. The width of the openings 108 correspond to a clearance, i.e. minimum distance, between neighboring ribs 103, for example. The reinforcement sheet 106 further has a window 110 for the OMAS 104. This enables the OMAS 104 to monitor the advance of print media through the window 104 when the platen protector 105 is installed at the printer device 100.

Figure 7A:
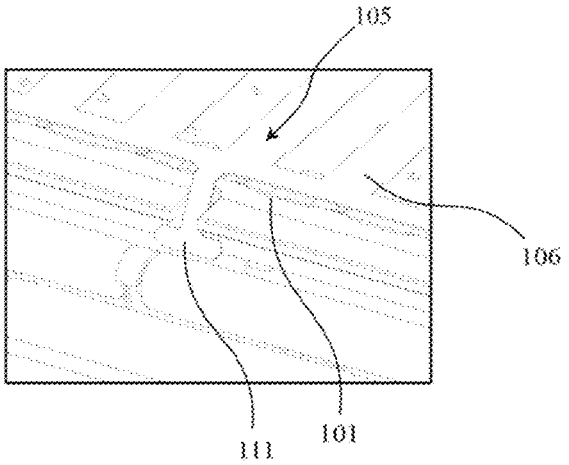
FIGS. 7*a*, 7*b* and 7*c* illustrate a fixation system of the platen protector.

The example platen protector 105 has a fixing system to fixate the platen protector 105 relative to the printer platen 101. As illustrated in FIG. 7*a*, as regards example platen protectors 105 being equipped with a reinforcement sheet 106, the fixing system has foldable flanges 111 of the reinforcement sheet 106 as tensioner elements to align the platen protector 105 relative to the printer platen 101 and to apply tension to the reinforcement sheet 106 to fixate the reinforcement sheet 106 at the printer platen 101. For example, the flanges 111 can be snapped in a recess of the printer platen 101 as illustrated in FIG. 7*a*.

Figure 7B:
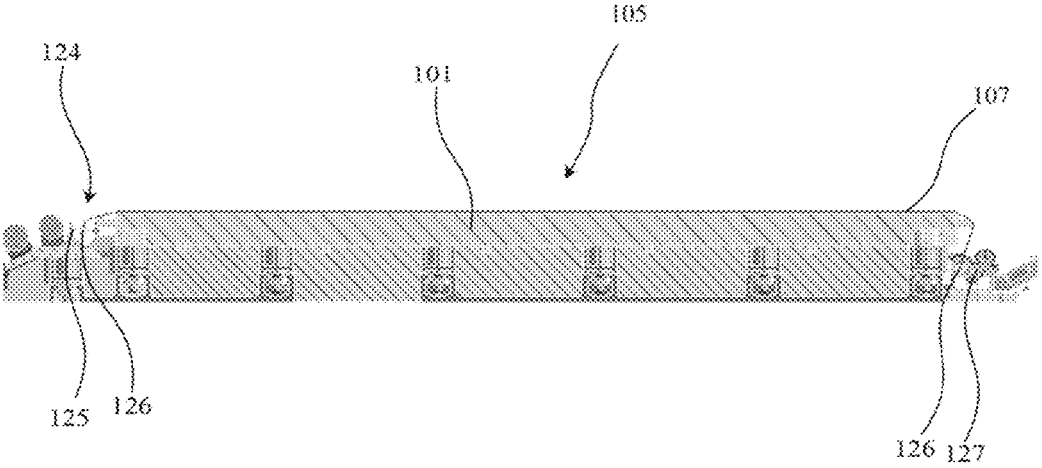

As illustrated in FIG. 7*b*, the fixing system of the platen protector 105 has magnetic fixation devices 124 of the protector blanket 107, e.g. to fix the protector blanket 107 to a rear part of the printer platen 101, e.g. between a main roller and the printer platen 101. The magnetic fixation devices 124 include, for example, a plastic extrusion member 125 with multiple rails to introduce, in one of them, a rod 126 glued to the protector blanket 107 to fix the blanket with the magnetic fixation device 124. The magnetic fixation devices 124 allow for simply installing and removing the protector blanket 107 to and from the printing plate 101, e.g. by a single operator.

Furthermore, the fixing system of the platen protector 105 has tensioner elements 127. For example, after fixing the protector blanket 107 on the printer platen 101 with the magnetic fixation devices, the protector blanket 107 can be stretched over the printer platen surface, and then fixed by the tensioner elements 127. A tensioner element 127 is a plastic extrusion member with a shape that provides the tensioner element 127 with elasticity to be introduced in a position tensioned over the printer platen 101 and being snapped to the printer platen 101. By a nose shape, the tensioner elements 127 permit to easily install and remove the protector blanket 107 manually.

Figure 7C:
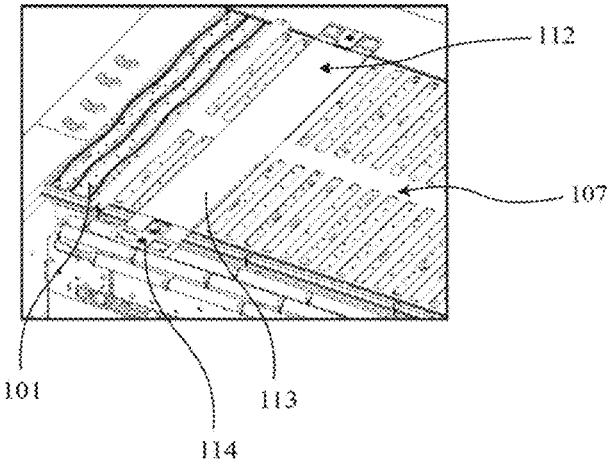

As illustrated in FIG. 7*c*, the fixing system further has edge holders 112 to hold down the protector blanket 107 towards the printer platen 101. For example, the edge holder 112 has an elastic belt 113 to cover the leading or trailing edges of the protector blanket 107 and tensioners 114 on either side of the elastic belt 113 to apply tensioning forces to hold down the protector blanket 107.

Figure 8:
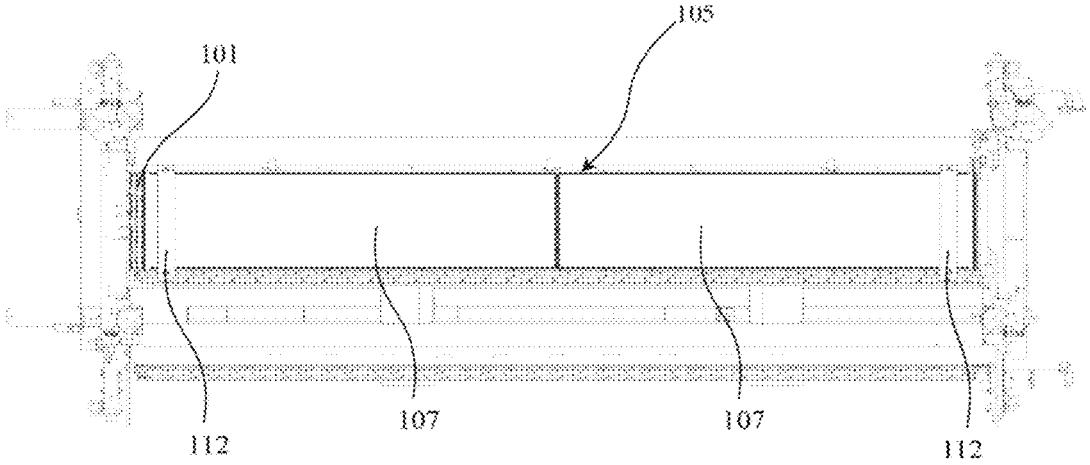
FIG. 8 illustrates a two-piece protector blanket example of a platen protector.

As illustrated in FIG. 8, the example platen protector 105 has two protector blanket 107 each covering one half of the printer platen 101, i.e. each protector blanket 107 has a length which corresponds to half the length of the printer platen 101. Such a two-piece protector blanket platen protector makes it easier for the operator of the printer device 100 to install and de-install the platen protector 105, for example. FIG. 8 further illustrates respective edge holders 112 at either short side of the pair of reinforcement sheets 106. A still further edge holder (not shown in FIG. 8) is installed at the boundary of the two protector blankets 107. In some other examples, the platen protector has a single reinforcement sheet that has substantially the same length as the printer platen.

Figure 9:
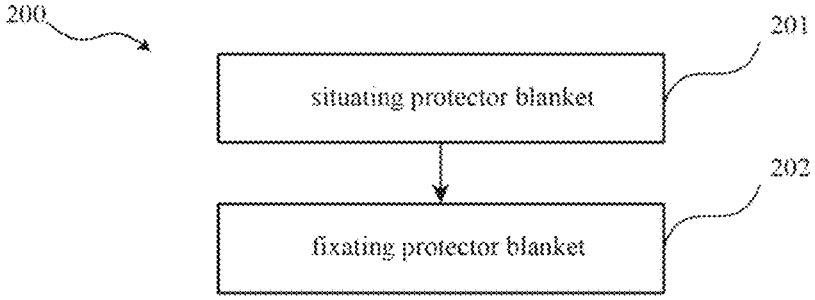
FIG. 9 schematically illustrates a method of installing the platen protector to the printer platen.

FIG. 9 schematically illustrates an example method 200 of installing the platen protector 105 at the example printer device 100 described with regard to FIG. 1-8. The method 200 includes, in box 201, to situate the protector blanket 107 over the printer platen 101. In some examples, a two-piece protector blanket 107, i.e. the two protector blankets 107 having half the length of the printer platen 101, makes it easier for the operator to handle the protector blankets 107 for situating them over the printer platen 101.

The example method 200 further includes, in box 202, fixating the protector blanket(s) 107 relative to the printer platen 101 by the fixing system. In some examples, this includes fixating the magnetic fixation devices to the printer platen 101 and/or snapping the bendable flanges 111 into corresponding recesses of the printer platen 101. In some examples, the method further includes attaching one, two or three edge holders to the printer platen at the reinforcement sheet(s) short sides.

In some example methods of installing the platen protector 105 to the printer device 100, the method further includes aligning the protector blanket 107 by taking the OMAS 104 and the window 110 as references for alignment. In some examples, the shape of the windows 110 is a hole in the protector blanket 107 and the hole's shape corresponds to the contour of the OMAS 104. In some examples, the method of installing the platen protector 105 at the example printer device 100 further includes to (slightly) push down the protector blanket 107, e.g. by a fingertip, nearby the windows 110 to catch the OMAS 104 with the window 110. By catching the OMAS 104 with the windows 110 the protector blanket 107 can be aligned relative to the printer platen 101.

In some example methods of installing the platen protector 105 to the printer device 100, the method further includes installing the reinforcement sheet 106 before installing the protector blanket 107. For example, these example methods further include aligning the reinforcement sheet 106 by taking the OMAS 104 and the window 110 as references for alignment. For example, the shape of the windows 110 is a hole in the reinforcement sheet 106 and the hole's shape corresponds to the contour of the OMAS 104. For example, the example methods further includes to (slightly) push down the reinforcement sheet 106, e.g. by a fingertip, nearby the windows 110 to catch the OMAS 104 with the window 110. By catching the OMAS 104 with the windows 110 the reinforcement sheet 106 can be aligned relative to the printer platen 101.

A still further example method of de-installing, e.g. by the operator of the printer device 100, the platen protector 105 from the printer device 100 includes to remove any edge holders 112 and to release the bendable flanges 111 and remove the protector blanket from the printer platen 101. In some of these examples, the method further includes removing the reinforcement sheet 106 from the printer platen 101.

Although some examples of methods and products have been described herein, other variations are generally within the scope of this description. As will be appreciated, the description generally contemplates various implementations fairly falling within the scope of the appended claims either literally or under the doctrine of equivalents.

The invention claimed is:

1. A platen protector for a printer device, the platen protector comprising:

a reinforcement sheet comprising a parallel series of openings separated by a bar, wherein the bar between the parallel series of openings covers ribs of a printer platen;

a protector blanket on top of the reinforcement sheet to cover the reinforcement sheet to prevent from causing scratches on print media by the printer platen, wherein the protector blanket is porous to pass through vacuum applied by the printer platen to attract the print media; and a fixing system to fixate the platen protector relative to the printer platen.

2. The platen protector according to claim 1, wherein the protector blanket comprises a textile.

3. The platen protector according to claim 1, wherein the protector blanket is anti-static.

4. The platen protector according to claim 1, wherein the protector blanket is flame retardant.

5. The platen protector according to claim 1, wherein the protector blanket is black.

6. The platen protector according to claim 1, further comprising:

a window for an optical media advance sensor arranged at the printer platen to monitor advance of print media through the window.

7. The platen protector according to claim 1, wherein the fixing system comprises a magnetic fixation device.

8. The platen protector according to claim 1, wherein the fixing system comprises a tensioner element.

9. The platen protector according to claim 1, wherein the fixing system comprises a rod.

10. The platen protector according to claim 1, wherein the fixing system comprises an edge holder to hold down the protector blanket towards the printer platen.

11. The platen protector according to claim 1, wherein a thickness of the protector blanket is about 0.3 mm.

12. The platen protector according to claim 1, wherein the platen protector comprises two separate protector blankets.

13. The platen protector according to claim 1, wherein the reinforcement sheet wherein the reinforcement sheet is stiffer than the protector blanket to reduce embossing of the protector blanket by the ribs of the printer platen and flatten the protector blanket and wherein the reinforcement sheet comprises an opening to pass through vacuum applied by the printer platen to attract the print media.

14. A printer device comprising:

a printer platen, wherein the printer platen comprises ribs and holes to apply vacuum to attract print media; and a platen protector, wherein the platen protector comprises:

a reinforcement sheet comprising a parallel series of openings separated by a bar, wherein the bar between the parallel series of openings covers the ribs of the printer platen;

a protector blanket on top of the reinforcement sheet to cover the reinforcement sheet to prevent from causing scratches on the print media by the printer platen, wherein the protector blanket is porous to pass through vacuum applied by the printer platen to attract the print media; and a fixing system to fixate the platen protector relative to the printer platen.

15. A method of installing a platen protector at a printer device, wherein the printer device comprises a printer platen, wherein the printer platen comprises ribs and holes to apply vacuum to attract print media;

the platen protector comprises a reinforcement sheet comprising a parallel series of openings separated by a bar, wherein the bar between the parallel series of openings covers the ribs of the printer platen, a protector blanket on top of the reinforcement sheet to cover the reinforcement sheet to prevent from causing scratches on the print media by the printer platen, wherein the protector blanket is porous to pass through vacuum applied by the printer platen to attract the print media, and a fixing system to fixate the platen protector relative to the printer platen, wherein the method comprises:

situating the protector blanket at the printer platen, and fixating the protector blanket relative to the printer platen by the fixing system.

* * * * *